US007216565B2

(12) United States Patent
Sherwood, Jr. et al.

(10) Patent No.: US 7,216,565 B2
(45) Date of Patent: May 15, 2007

(54) METHODS OF MANUFACTURING AND REPAIRING STEEL BODY ROTARY DRILL BITS INCLUDING SUPPORT ELEMENTS AFFIXED TO THE BIT BODY AT LEAST PARTIALLY DEFINING CUTTER POCKET RECESSES

(75) Inventors: William H. Sherwood, Jr., Spring, TX (US); L. R. Borremans, Conroe, TX (US); Robert J. Costo, Jr., The Woodlands, TX (US); James L. Duggan, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/374,918

(22) Filed: Mar. 14, 2006

(65) Prior Publication Data

US 2006/0150777 A1 Jul. 13, 2006

Related U.S. Application Data

(62) Division of application No. 10/715,050, filed on Nov. 17, 2003, now Pat. No. 7,070,011.

(51) Int. Cl.
*B21K 5/04* (2006.01)

(52) U.S. Cl. ..... 76/108.1; 76/108.2

(58) Field of Classification Search ..... 76/108.1, 76/108.2, 108.4, 108.6, DIG. 12; 175/432, 175/428

See application file for complete search history.

(56) References Cited

U.S. PATENT DOCUMENTS 4,014,395 A 3/1977 Pearson
4,199,035 A 4/1980 Thompson
4,200,159 A * 4/1980 Peschel et al. ..... 175/428
4,271,917 A 6/1981 Sahley
4,334,585 A 6/1982 Upton
4,351,401 A 9/1982 Fielder
4,382,477 A 5/1983 Barr
4,453,605 A 6/1984 Short, Jr.
4,465,148 A * 8/1984 Morris et al. ..... 175/428
4,505,342 A 3/1985 Barr et al.
4,529,048 A 7/1985 Hall
4,538,690 A 9/1985 Short, Jr.
4,553,615 A * 11/1985 Grainger ..... 175/432

(Continued)

FOREIGN PATENT DOCUMENTS

GB 2084219 4/1982

*Primary Examiner*—Lee D. Wilson
*Assistant Examiner*—Robert Scruggs
(74) *Attorney, Agent, or Firm*—TraskBritt

(57) ABSTRACT

A steel body rotary drag bit for drilling a subterranean formation includes a plurality of support elements affixed to the bit body, each forming at least a portion of a cutting element pocket. Each of a plurality of cutting elements has a substantially cylindrical body and is at least partially disposed within a cutter pocket. At least a portion of the substantially cylindrical body of each cutting element is directly secured to at least a portion of a substantially arcuate surface of the bit body. At least a portion of a substantially planar surface of each cutting element matingly engages at least a portion of a substantially planar surface of a support element.

12 Claims, 14 Drawing Sheets

U.S. PATENT DOCUMENTS 4,782,903 A 11/1988 Strange
4,877,096 A 10/1989 Tibbitts
4,993,505 A * 2/1991 Packer et al. ..... 175/431
5,007,493 A 4/1991 Coolidge et al.
5,056,382 A 10/1991 Clench
5,213,171 A 5/1993 Clench et al.
5,279,375 A 1/1994 Tibbitts et al.
H1566 H 8/1996 Azar
5,558,170 A * 9/1996 Thigpen et al. ..... 175/57
5,678,645 A 10/1997 Tibbitts et al.
5,890,552 A 4/1999 Scott et al.
5,906,245 A * 5/1999 Tibbitts et al. ..... 175/426
6,302,224 B1 * 10/2001 Sherwood, Jr. ..... 175/397

* cited by examiner

METHODS OF MANUFACTURING AND REPAIRING STEEL BODY ROTARY DRILL BITS INCLUDING SUPPORT ELEMENTS AFFIXED TO THE BIT BODY AT LEAST PARTIALLY DEFINING CUTTER POCKET RECESSES

CROSS-REFERENCE TO RELATED APPLICATION

This application is a divisional of U.S. patent application Ser. No. 10/715,050, filed Nov. 17, 2003, now U.S. Pat. No. 7,070,011 issued Jul. 4, 2006.

BACKGROUND OF THE INVENTION

1. Field of the Invention

The present invention relates generally to steel body rotary drag bits and, more specifically, to retention of generally cylindrical cutting elements within steel bodied rotary drag bits for drilling subterranean formations.

2. State of the Art

Steel bodied rotary drag bits employing cylindrical polycrystalline diamond compact ("PDC") cutters have been employed for drilling subterranean formations for a relatively long time. PDC cutters comprised of a diamond table formed under ultra-high temperature, ultra-high pressure conditions onto a substrate, typically of cemented tungsten carbide (WC), were introduced about twenty-five years ago. Steel drill bit bodies are typically fabricated by machining a piece of steel to form generally radially extending blades, cutting element sockets or pockets, junk slots, internal watercourses and passages for delivery of drilling fluid to the bit face, ridges, lands, and other external topographic features of the drag bit. A threaded pin connection for securing the drill bit body to the drive shaft of a downhole motor or directly to drill collars at the distal end of a drill string rotated at the surface by a rotary table or top drive may typically be machined separately from a different steel grade and then may be affixed to the bit body by welding.

Conventional cutting element retention systems generally comprise two styles: (1) tungsten carbide studs comprising a cylindrical tungsten carbide cylinder having a face oriented at an angle (backrake angle) with respect to the longitudinal axis of the cylinder, the face carrying a superabrasive cutting structure thereon, wherein the cylinder is press-fit into a recess that is generally oriented perpendicularly to the blades extending from the bit body on the bit face; and (2) mechanical and/or brazed attachment of a generally cylindrical cutting element into a recess formed on the bit face, typically on a blade extending therefrom. Regarding the first cutting element retention style, PDC cutting elements may be brazed to the face, or other superabrasive structures may be affixed thereto, by infiltration or brazing, such as thermally stable diamonds (TSPs). Accordingly, the first cutting element retention style is designed for a stud-type cutting element, while the second cutting element retention style is designed for generally cylindrical cutting elements, such as PDC cutters. In either system, the goals are to provide sufficient cutting element attachment and retention as well as mechanical strength sufficient to withstand the forces experienced during the drilling operation.

Of the two different types of cutting element retention configurations utilized in the manufacture of steel body rotary drill bits, generally cylindrical cutting elements are generally preferred and almost uniformly utilized therefor.

Stud-type cutting elements, on the other hand, are relatively uncommon and may require a brazing or infiltration cycle to affix the PDC or TSPs to the stud. Therefore, it may be preferable to form a recess into a steel body bit blade that has the shape of a flat-ended, right cylinder. Often, the preferred method of machining a flat-ended cylinder is by plunging a rotating flat-bottomed machining tool, such as an end mill disposed at the angle desired for backrake into the rotationally leading face of a bit blade along the axis of rotation of the end mill. Such a machining operation may yield a cutting element pocket having a substantially cylindrical surface and a substantially planar end surface for disposing and brazing a generally cylindrical cutting element therein.

Although generally cylindrical cutting elements are almost uniformly employed in manufacturing steel body rotary drill bits, difficulties may arise in machining the recesses therefor within the steel body. For instance, there may be interference between the machining equipment used, such as a multiple-axis milling machine, and the drill bit blades. More specifically, the interference may inhibit a desired machining path of a machining tool that is aligned generally along the axis of rotation thereof because the collect or chuck that retains the machining tool may contact an adjacent blade.

Notwithstanding use of a right angle converter to reduce the amount of clearance required, or a longer machining tool which may allow for the collect or chuck holding the machining tool to be positioned at a greater distance from the bit body, in steel-body rotary drill bit designs where adjacent blades are relatively close to one another, interference may still exist. Therefore, bit designs including blades that are relatively near to each other may prevent effective machining of cutting element pockets because an adjacent bit blade may intersect the projection of the cutting element recess geometry itself. Put another way, in order to form the desired cutting element recess having an arcuate surface for conforming to the generally cylindrical portion of a generally cylindrical cutting element and a substantially planar end surface for supporting the generally cylindrical cutting element by way of a flat-bottomed machining tool, such as an end mill, the machining tool may be required to remove a portion of the rotationally leading adjacent blade. As a further complication, drill bit profile designs often taper longitudinally away from the direction of drilling precession as the profile approaches the center of the face of the drill bit. Thus, near the center of the bit, use of a flat-bottomed machining tool to form recesses for generally cylindrical cutting elements within steel body rotary drill bits may be extremely difficult. For this reason, steel body rotary drill bit design may be limited in flexibility in order to utilize the relatively popular generally cylindrical cutting element.

As shown in FIGS. 1A and 1B, conventional steel body rotary drill bit body 10 may typically comprise generally longitudinally extending and radially-directed upwardly projecting blades 34. Cutting element pockets 30 may be formed within blades 34 proximate intervening junk slots 36 for retaining cutting elements (not shown) for engaging and cutting the formations during rotation of the conventional steel body rotary drill bit body 10 as known in the art. In addition, nozzle cavities 18 may be formed for accepting nozzles (not shown) for communicating drilling fluid from the interior of the steel body rotary drill bit body 10 to the cutting elements (not shown) and face 38 of the conventional steel body rotary drill bit body 10. As known in the art, conventional steel body rotary drill bit body 10 may be affixed to a bit shank to form a steel body rotary drill bit wherein the shank includes an end for connection to a drill string or, alternatively, to a down hole drill motor assembly.

Cutting element pockets 30 formed in blades 34 are of a general right cylindrical shape as shown in FIGS. 1A and 1B. As may be further seen with respect to FIGS. 1A and 1B, cutting element pockets 30 proximate the inner radial region 26 of conventional steel body rotary drill bit body 10 may be difficult to form conventionally. Further, as blades 34 extend nearer to one another, especially within the inner radial region 26 of conventional steel body rotary drill bit body 10, conventional cutting element pockets 30 may become difficult to form. As may be further noted, a cutting element pocket 30 of a conventional steel body rotary drill bit body 10 may not fully support the substantially planar surface of a cutting element disposed therein because the cutting element pocket 30 may extend only to the top surface of the blade 34. However, the conventional cutting element pockets 30 may be machined in such a way as to form supporting backings (not shown) that extend above the upper surface of the blade 34, in conformity with the substantially planar surface of a generally cylindrical cutting element (not shown), but such machining may be time intensive and expensive.

Furthermore, generally cylindrical cutting elements (not shown) may typically be brazed within the cutting element pockets 30 formed within the conventional steel body rotary drill bit body 10. While brazing may be generally adequate under moderate drilling conditions, generally cylindrical cutting elements may fracture during drilling, and conventional brazing configurations may not prevent the fractured portion of the generally cylindrical cutting elements from becoming detached from the conventional steel body rotary drill bit body 10, and may thereby likely cause damage to other generally cylindrical cutting elements affixed thereto.

U.S. Pat. No. 4,453,605 to Short discloses a metallurgical and mechanical holding of cutters in a matrix-type rotary drill bit.

U.S. Pat. No. 5,056,382 to Clench discloses a method for forming the displacements within a mold to form matrix cutter pockets by way of two independent end mill passes within a matrix-type rotary drag bit mold.

U.S. Pat. No. 5,558,170 to Thigpen et al. discloses a cylindrical cutting element having a spherical end that may be mechanically locked by the side walls of the recess formed therefor.

Therefore, it would be advantageous to provide an improved cutting element retention configuration for use in steel body rotary drag bits. Further, it would be advantageous to provide a cutting element retention apparatus that is implementable by way of conventional machining equipment and improves flexibility of design. In addition, it would be advantageous to provide a cutting element retention apparatus that provides mechanical locking of at least a portion of the cutting element within the steel body rotary drill bit.

BRIEF SUMMARY OF THE INVENTION

The present invention, in exemplary embodiments, relates to improved configurations for retention of generally cylindrical cutting elements within a steel-bodied rotary drag bit. Accordingly, one aspect of the present invention contemplates a steel body rotary drill bit having at least one cutter element retention configuration according to the present invention.

Generally, a cutting element pocket according to the present invention comprises a substantially planar surface for matingly engaging the substantially planar surface of a generally cylindrical cutting element distal to the cutting face and an arcuate surface for matingly engaging at least a portion of the circumference of the generally cylindrical cutting element. Of course, the present invention is not so limited to perfectly cylindrical cutting elements, but rather encompasses generally or substantially cylindrical cutting elements.

In one embodiment of the cutting retention apparatus of the present invention, a support element may be disposed within a recess and affixed to the bit body by way of an anchor element. The anchor element may affix the support element to the bit body by extending therethrough, engaging thereagainst, or by interference fit within a retention recess. The geometry and position of the support element may form at least a substantially planar surface of a cutting element pocket for disposing a generally cylindrical cutting element therein.

In another embodiment of the cutting retention apparatus of the present invention, a recess may be formed within a bit blade, and a support element itself may be press fit into a retention recess that at least partially intersects the recess in order to form a cutting element pocket. The support element may form at least the substantially planar surface of the cutting element pocket, both the substantially planar surface and a portion of the arcuate or semi-cylindrically shaped surface of a cutting element pocket or, alternatively, substantially the entire cutting element pocket.

Further, in any of the above embodiments, the generally cylindrical cutting element may be mechanically locked within a cutting element pocket by the geometry and/or configuration of the pocket itself. Put another way, the cutting element pocket may encompass more than half of a cross-sectional circumference of the generally cylindrical cutting element at any point along the generally cylindrical surface thereof. Additionally, in any of the above embodiments, the generally cylindrical cutting element may be disposed at a backrake angle as known in the art.

In addition, a method of manufacture of a steel-bodied rotary drag bit is disclosed wherein a cutting pocket is formed at least partially by a support element. Generally, a retention recess may be formed within a steel bit body and a support element affixed or positioned thereby. The support element may form at least a portion of a cutting element pocket for disposing and affixing a generally cylindrical cutting element therein. Further, a generally cylindrical cutting element may be replaced within a steel body rotary drill bit. More specifically, a cutting element disposed within a cutting pocket at least partially formed by way of a support element may be replaced. Of course, a support element forming at least a portion of a cutting element pocket may also be replaced.

DETAILED DESCRIPTION OF THE INVENTION

Figure 1A:
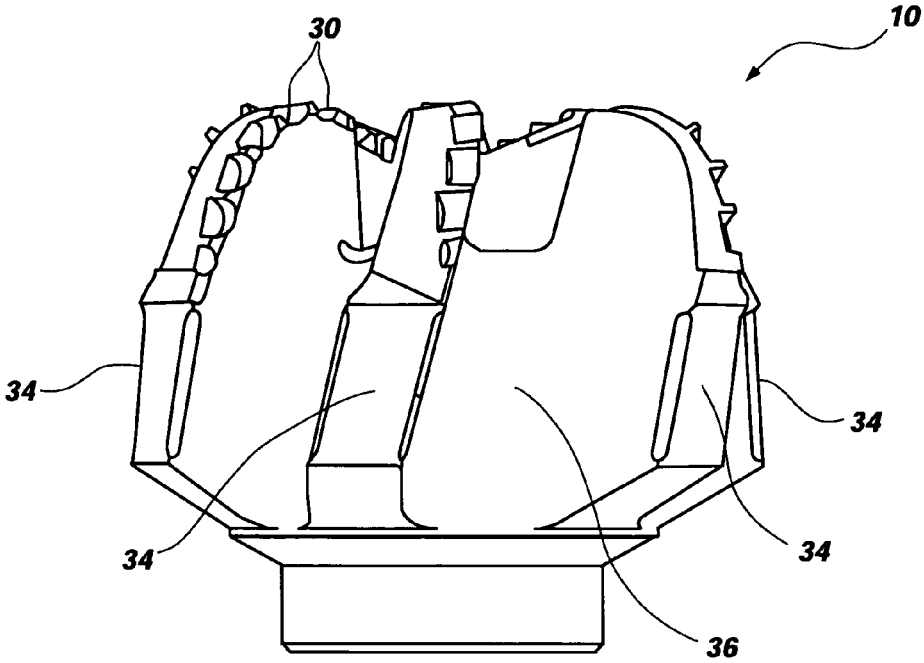
FIG. 1A shows a side view of a conventional steel body rotary drill bit.
Figure 1B:
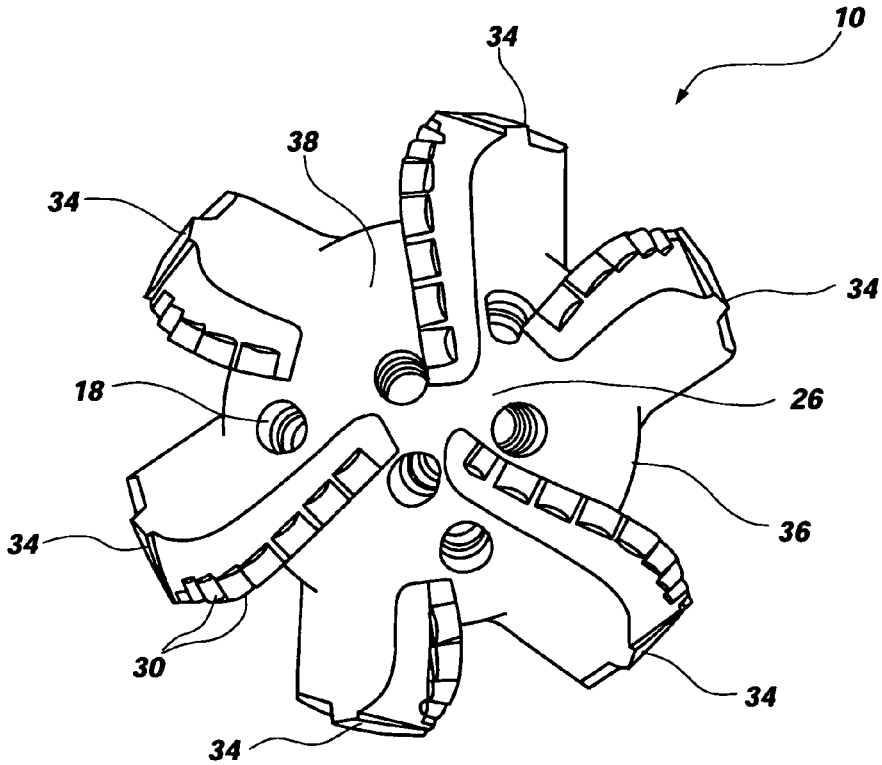
FIG. 1B shows a top view of a conventional steel body rotary drill bit.
Figure 2A:
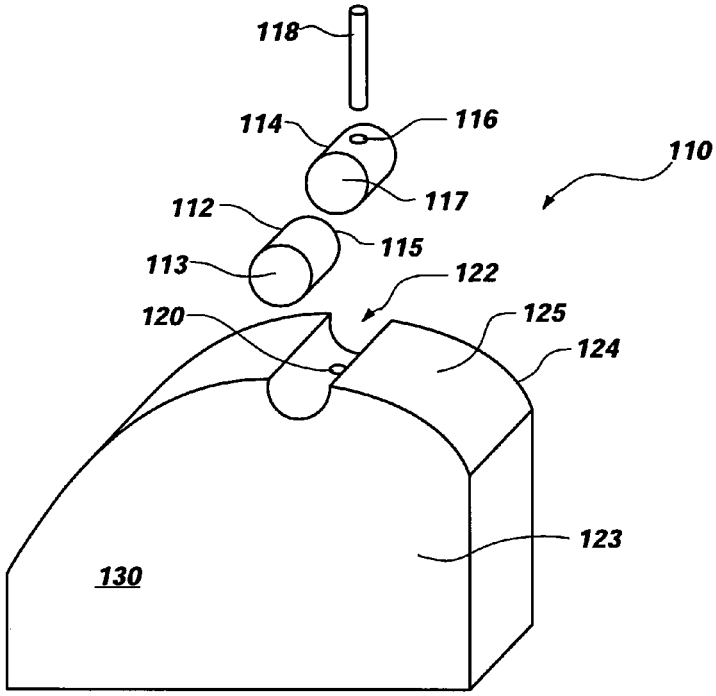
FIG. 2A shows an exploded perspective assembly view of an embodiment of the cutting element retention apparatus of the present invention.
Figure 2B:
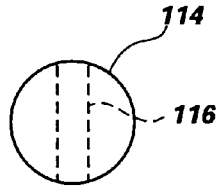
FIG. 2B shows a front view of the support element as shown in FIG. 2A.

FIG. 2A shows an exploded perspective assembly view of a first embodiment of the cutting element retention apparatus 110 of the present invention. More specifically, FIG. 2A shows a bit blade 130 having a recess 122 formed therein sized and configured to accept a support element 114 and generally cylindrical cutting element 112 having a cutting face 113 and distal substantially planar surface 115. Recess 122 may be partially cylindrical or arcuate at its lowermost surface and may therefore be formed by way of a machining bit blade 130 with a hemispherical or at least partially spherical ended tool along a straight path between leading face 123 and trailing face 124 thereof. Leading face 123 generally refers to the region of the bit blade 130 that is rotationally forward or leading in relation to the direction of rotation of the bit body during drilling. Support element 114 may comprise a generally cylindrically shaped body having an aperture 116 formed through the circumference thereof and a front surface 117 configured to matingly engage and support a cylindrical cutting element 112 disposed therein, as illustrated by FIGS. 2A and 2B, FIG. 2B showing a front view of the support element 114.

Figure 2E:
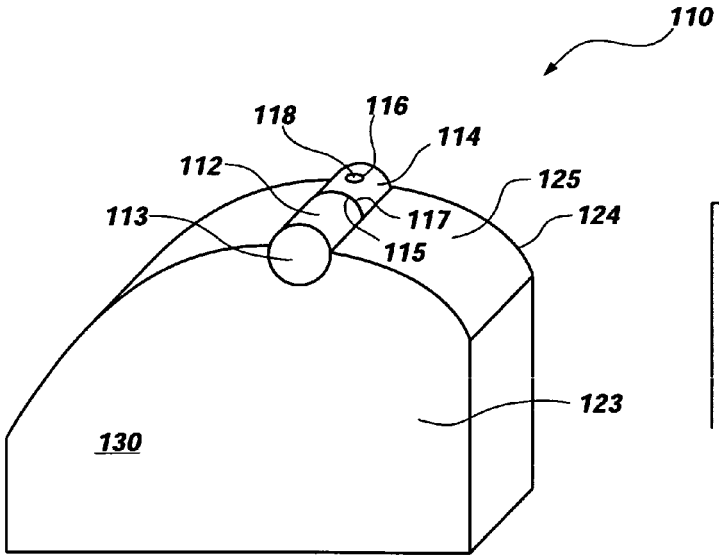
FIG. 2E shows a perspective view of the assembled cutting element retention apparatus of FIG. 2A.
Figure 2D:
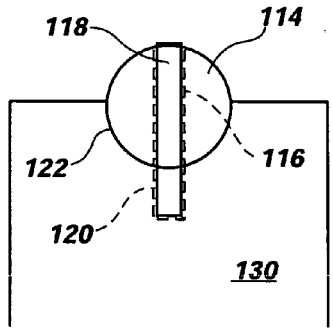
FIG. 2D shows a front cross-sectional view of the support element disposed within the recess as shown in FIG. 2C.
Figure 2C:
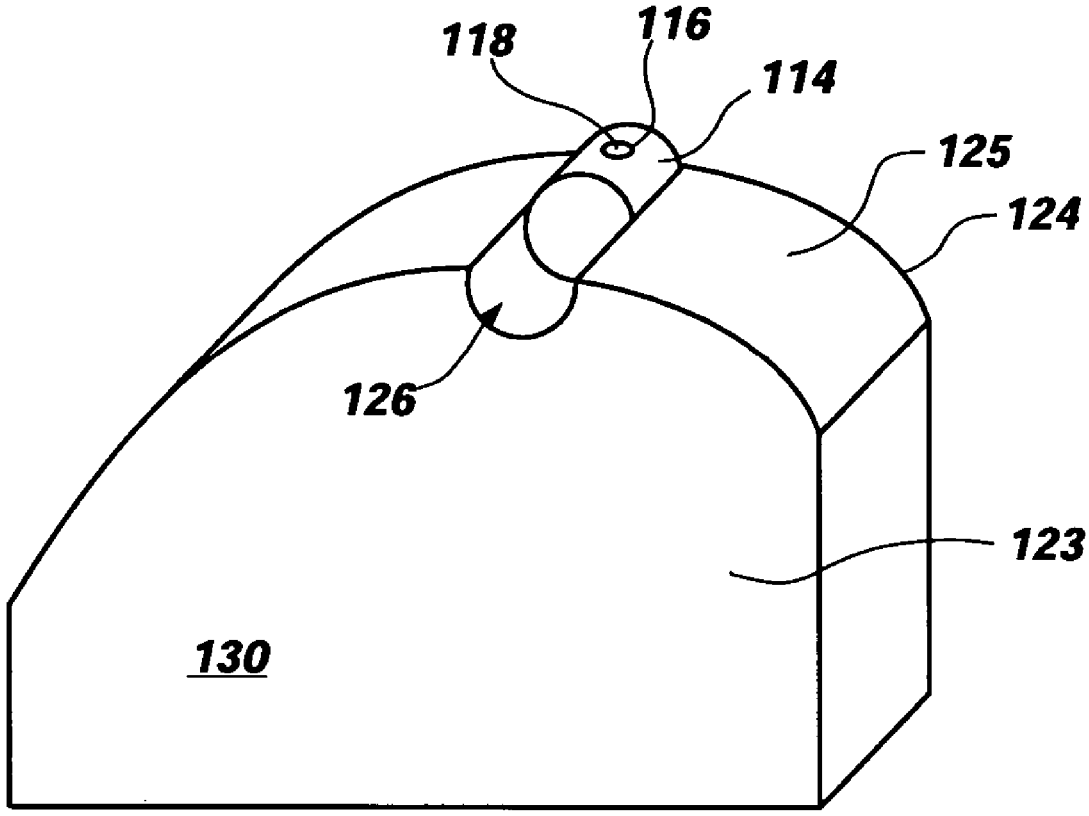
FIG. 2C shows a perspective view of the cutting element retention apparatus as shown in FIG. 2A wherein the support element is disposed within the recess.

FIG. 2C shows a perspective view of the assembled cutting element retention apparatus 110 as shown in FIG. 2A wherein support element 114 is disposed within recess 122. Further, FIG. 2D shows a cross-sectional view of the cutting element retention apparatus 110 as shown in FIG. 2C, the cross-sectional view taken perpendicular to the direction of the axis of the arcuate surface of the recess 122. Support element 114 disposed within recess 122 may be affixed to bit blade 130, at least partially, by way of anchor element 118 disposed within aperture 116 as well as corresponding retention recess 120 formed in bit blade 130. Anchor element 118 may engage support element 114 and may fit within aperture 116 and/or retention recess 120 by interference fit or by sliding fit. Thus, support element 114 may be disposed within recess 122 to form cutting element pocket 126.

Of course, as shown in FIG. 2E, generally cylindrical cutting element 112 may be preferably disposed within cutting element pocket 126 (FIG. 2C) so that at least a portion of substantially planar surface 115 thereof matingly engages front surface 117 of support element 114. Such a configuration may provide support for the generally cylindrical cutting element 112 during drilling. Additionally, generally cylindrical cutting element 112 may be affixed to the bit blade 130 and/or support element 114 via brazing, welding, or as otherwise known in the art. Of course, brazing or welding may also secure any of the anchor element 118, support element 114, and/or bit blade 130 to one another. Alternatively, anchor element 118 may be designed to deform within retention recess 120 and/or aperture 116 to affix the support element 114 to the bit blade 130. Accordingly, anchor element 118 may extend through, engage against, or fit interferingly in relation to the support element 114. Thus, support element 114 and anchor element 118 may position generally cylindrical cutting element 112 within the cutting element pocket 126 (FIG. 2C) and also support the generally cylindrical cutting element 112, in combination with subsequent brazing and/or welding, against forces experienced while drilling.

As may also be seen in FIG. 2E, the uppermost portion of the cutting face 113 of the cutting element 112 may be positioned above the upper surface 125 of the bit blade 130, to provide clearance therebetween. Such clearance, or cutting element exposure, may be necessary so that the cutting element 112 contacts the subterranean formation to be drilled, thus cutting and removing material from the formation. Excessive contact between the bit blade 130 and the formation (not shown) may inhibit cutting by the cutting elements on a drill bit. Further, cutting face 113 of generally cylindrical cutting element 112 may be disposed at a backrake angle (not shown).

As known in the art, generally cylindrical cutting elements, such as PDC cutters, may be typically oriented so that the cutting face 113 exhibits a negative backrake angle, or, in other words, so that the cutting face 113 leans away from the surface of the formation during drilling. Further, each generally cylindrical cutting element 112 located at a given radius on a bit crown (not shown) will traverse through a helical path upon each revolution of the drill bit during drilling. The geometry (pitch) of the helical path is determined by the rate of penetration of the bit (ROP) and the rotational speed of the drill bit. The pitch may affect the so-called "effective backrake" of the cutter, because it affects the geometry of the surface of the formation and the trajectory of the generally cylindrical cutting element 112, as known in the art.

Figure 3A:
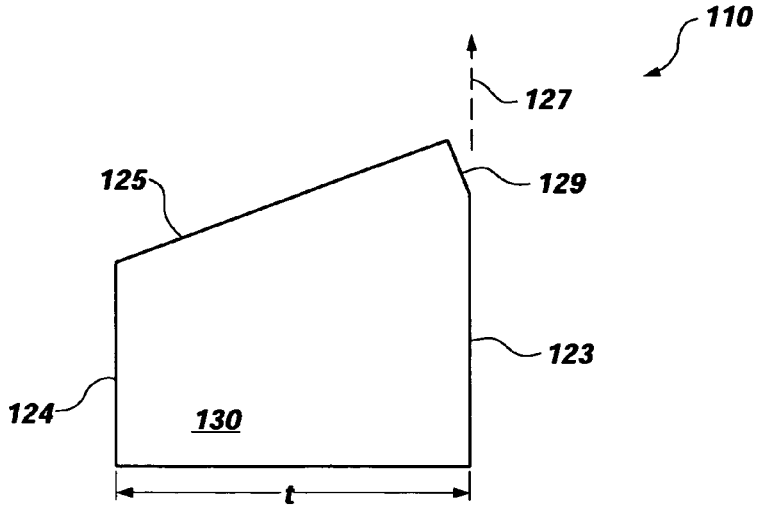
FIGS. 3A–3F show a side cross-sectional view of the formation and assembly of a cutting element retention apparatus of the present invention.

FIGS. 3A–3F illustrate a cutting element retention apparatus 110 of the present invention, including an exemplary process which may be used in the formation thereof. Further, FIGS. 3A–3F illustrate a cutting element retention apparatus 110 that disposes a generally cylindrical cutting element 112 at a selected backrake angle 128. FIG. 3A shows a cross-sectional view of bit blade 130 having a leading face 123 and a trailing face 124. Reference axis 127 is parallel to the longitudinal axis of the drill bit (not shown). Bit blade 130 also includes upper surface 125 as well as chamfer 129. Chamfer 129 is sized and configured so that the cutting face 113 of generally cylindrical cutting element 112 may not be disposed within the arcuate surface of recess 122. Such a configuration may improve the ability to remove cuttings from the cutting face 113 of the generally cylindrical cutting element 112. Of course, the bit blade 130 shape may be tapered, rounded, or arcuately shaped in extending from the bit body (not shown) along both the leading face 123 and trailing face 124.

Figure 3B:
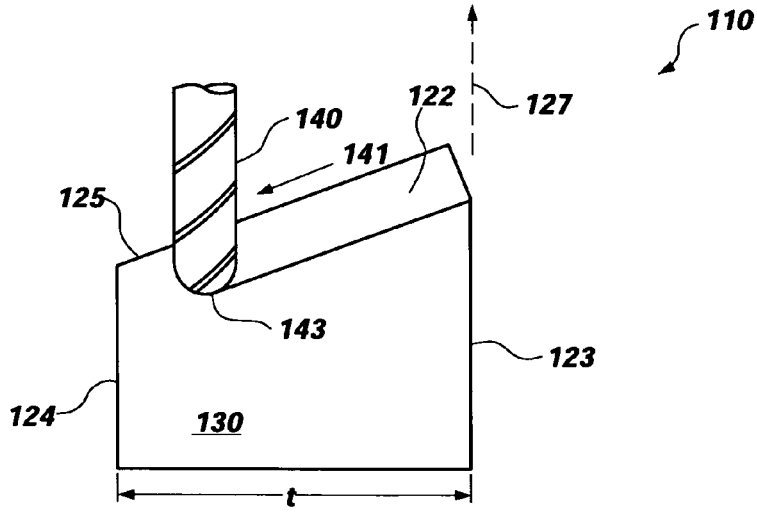
Figure 3C:
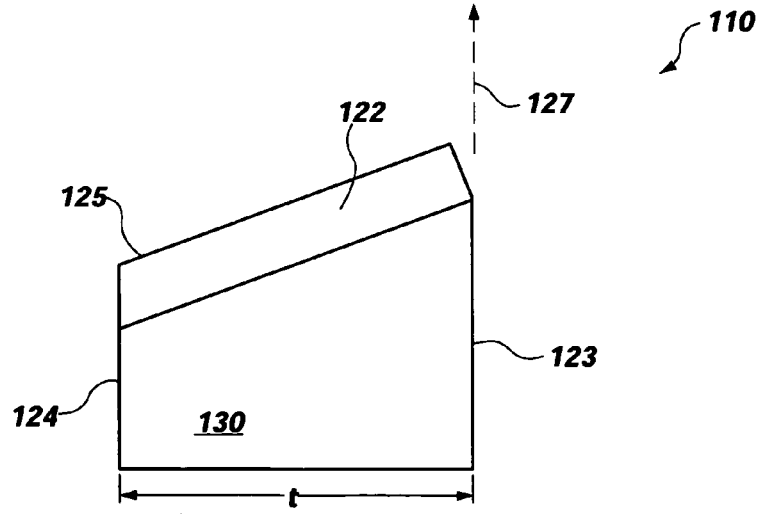
Figure 3D:
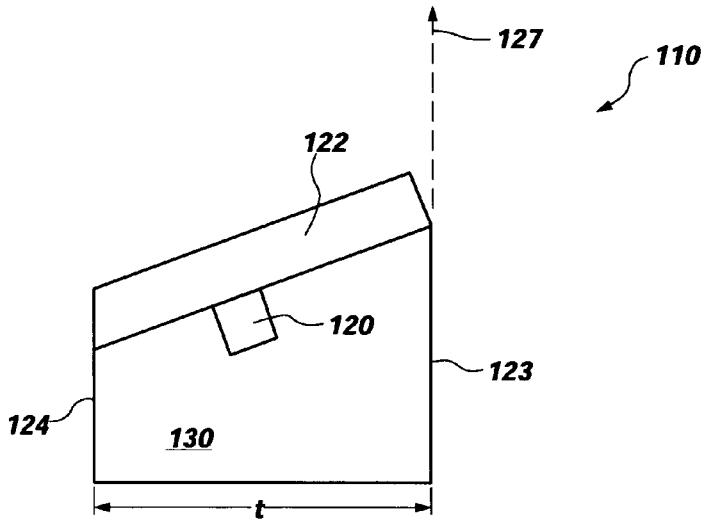
Figure 3E:
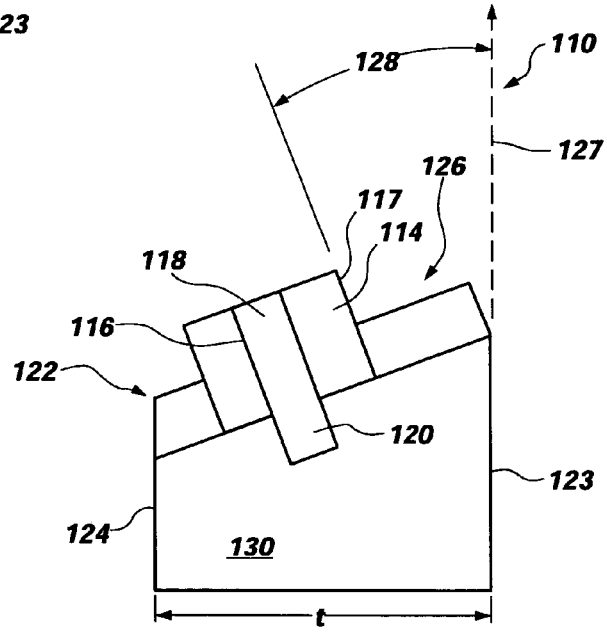
Figure 3F:
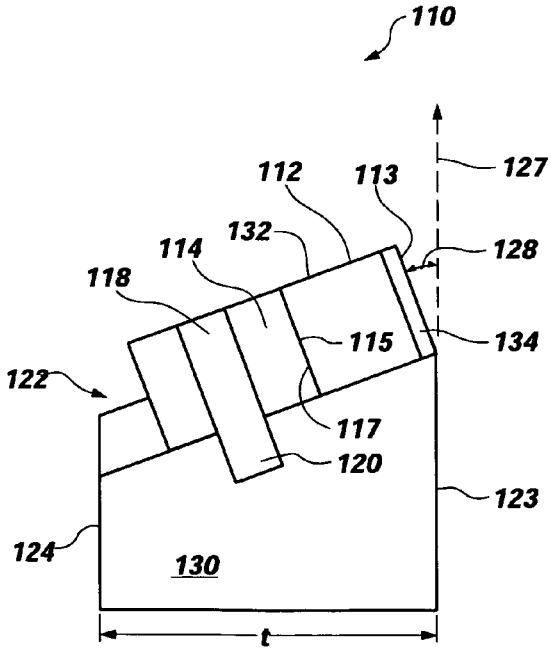

FIG. 3B shows a cross-sectional view of a machining operation in the process of forming recess 122. As shown in FIG. 3B, upper surface 125 of bit blade 130 may taper toward the bit body (not shown) to allow for clearance with respect to the formation during drilling thereof. As also shown in FIG. 3B, machining tool 140 may comprise a hemispherical end 143. Machining tool 140 is moved along a straight line along direction 141 between leading face 123 and trailing face 124 to form recess 122. FIG. 3C shows a cross-sectional view of recess 122 extending through the thickness t of bit blade 130. FIG. 3D shows a cross-sectional view of recess 122 wherein retention recess 120 is oriented substantially perpendicular to the direction 141 of formation of recess 122. Of course, other orientations of the retention recess 120 are contemplated by the present invention, depending on the geometry and configuration of the support element 114, bit blade 130, and generally cylindrical cutting element 112. Further, FIG. 3E shows support element 114 disposed within recess 122 affixed to bit blade 130 by way of anchor element 118 disposed within aperture 116 of support element 114 as well as retention recess 120 of bit blade 130. Support element 114, as shown in FIG. 3E, forms cutting element pocket 126 wherein front surface 117 of support element 114 is oriented at a backrake angle 128 with respect to reference axis 127. FIG. 3F shows a cross-sectional view of cutting element 112 disposed within recess 122, wherein at least a portion of the substantially planar surface 115 of the cutting element 112 matingly engages the front surface 117 of support element 114. Thus, cutting face 113 of cutting element 112 may be disposed at backrake angle 128 with respect to reference axis 127. Cutting element 112, as shown in FIG. 3F, may comprise a superabrasive layer 134 which forms cutting face 113 affixed to substrate 132, such as in the case of a PDC cutter.

Of course, many alternatives are contemplated by the present invention. For instance, support element 114 may comprise a steel composition, a cemented tungsten carbide, hardfacing material, or any material suitable to position and/or support a generally cylindrical cutting element 112. Carefully selecting the material of the support element 114 may be advantageous in order to provide a sufficiently stiff supporting structure for the generally cylindrical cutting element 112 during drilling. Alternatively, the support element 114 may merely position the generally cylindrical cutting element 112 prior to brazing and/or welding.

Further, the front surface 117 of support element 114 may be sized and configured to matingly engage substantially planar surface 115 of generally cylindrical cutting element 112. More specifically, the substantially planar front surface 117 of the support element. 114 may engage a portion of the substantially planar surface 115 of generally cylindrical cutting element 112 or the entire substantially planar surface 115 thereof. Accordingly, at least a portion of the substantially planar surface 115 of the generally cylindrical cutting element 112 may be supported. Of course, the size and configuration of the support element 114 may be tailored in relation to predicted forces or conditions. Additionally, methods of affixing the anchor element 118, support element 114, and/or bit blade 130 to one another, in any combination may include brazing, welding, press-fitting, shrink-fitting, deformation of the anchor element 118 within aperture 116 and/or retention recess 120, or as otherwise known in the art.

Figure 4A:
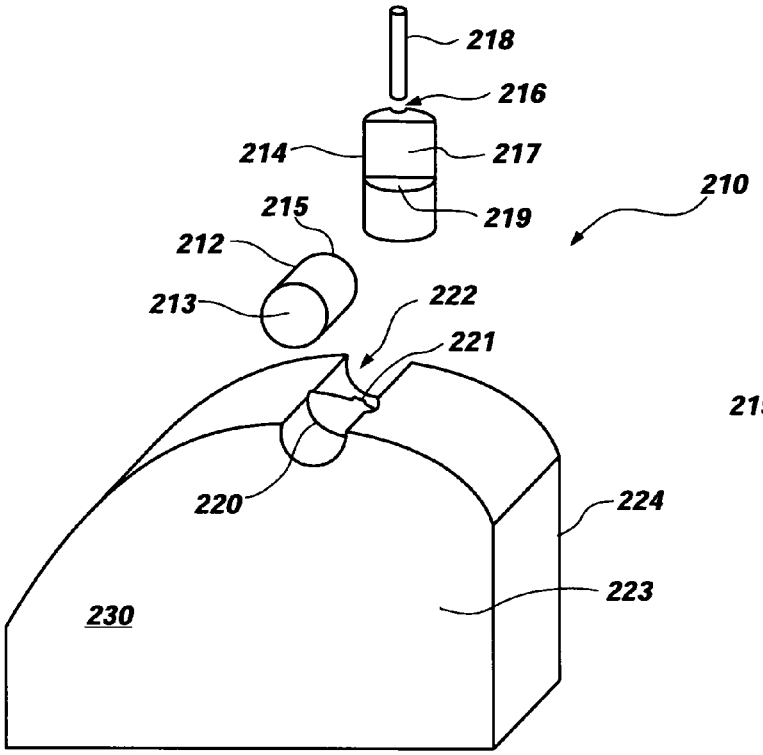
FIG. 4A shows an exploded perspective assembly view of an embodiment of the cutting element retention apparatus of the present invention.
Figure 4B:
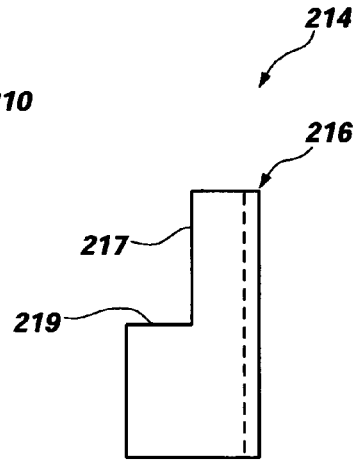
FIG. 4B shows a side view of the support element as shown in FIG. 4A.
Figure 4C:
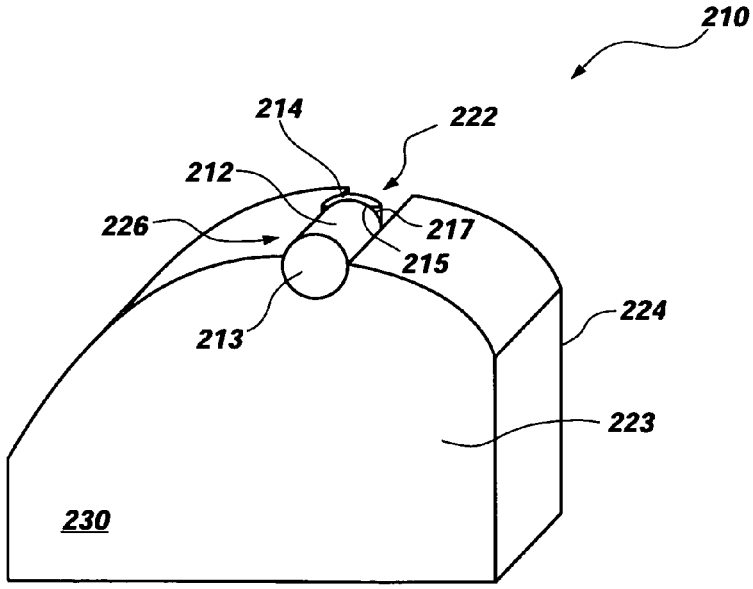
FIG. 4C shows a perspective view of the assembled cutting element retention apparatus shown in FIG. 4A.

FIGS. 4A–4F depict another embodiment of the cutting element retention apparatus 210 the present invention wherein recess 222 may be formed by a machining tool (not shown) having a hemispherical or at least partially spherical end that is moved along a straight path between the leading face 223 and trailing face 224 of bit blade 230, as shown in FIGS. 4A and 4C. Also, cutting element retention apparatus 210 may include support element 214 disposed within retention recess 220. As shown in FIGS. 4A and 4B, support element 214 may be shaped cylindrically, and may include front surface 217 for matingly engaging at least a portion of the substantially planar surface 215 of generally cylindrical cutting element 212. Support element 214 may also include alignment groove 216 and intermediate surface 219. Intermediate surface 219 may be substantially planar, or may be arcuate. Thus, intermediate surface 219 may be complementarily shaped with respect to the side of a generally cylindrical cutting element 212 in order to accept at least a portion of the circumference thereof upon assembly of support element 214 within retention recess 220 and generally cylindrical cutting element 212 within cutting element pocket 226, as shown in FIG. 4C.

Figure 4D:
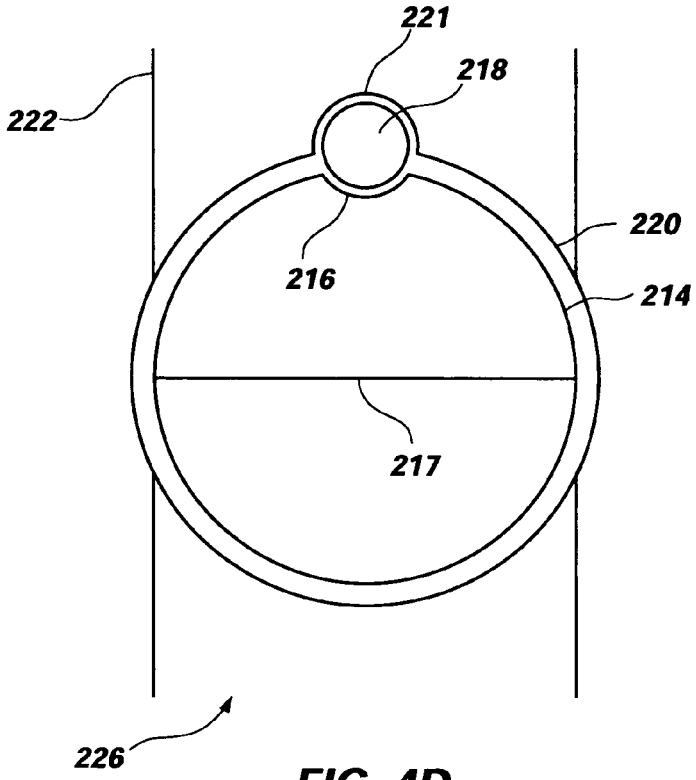
FIG. 4D shows a top view of the support element disposed in the retention recess as shown in FIG. 4A.

FIG. 4D shows a top view of support element 214 disposed within retention recess 220 disposed within recess 222. As FIG. 4D illustrates, alignment groove 216 of support element 214 and alignment groove 221 of retention recess 220 may be sized and configured to accept respective portions of alignment pin 218 in order to orient support element 214 within retention recess 220. Although retention recess 220 is shown as being larger than support element 214 in FIGS. 4D and 4E, interference therebetween is contemplated by the present invention. Therefore, support element 214 may be press-fit or shrink-fit into retention recess 220. Alternatively, alignment grooves 221 and 216 as well as alignment pin 218 may be sized and configured to bias support element 214 toward the leading face 223 of bit blade 230 so that the portion of support element 214 disposed within retention recess 220 contacts a surface thereof. Of course, such bias may be used to position the support element 214 within the retention recess 220. Support element 214 and/or generally cylindrical cutting element 212 may be brazed, welded, or otherwise affixed to bit blade 230 in order to provide adequate support to the generally cylindrical cutting element 212 during drilling.

Figure 4E:
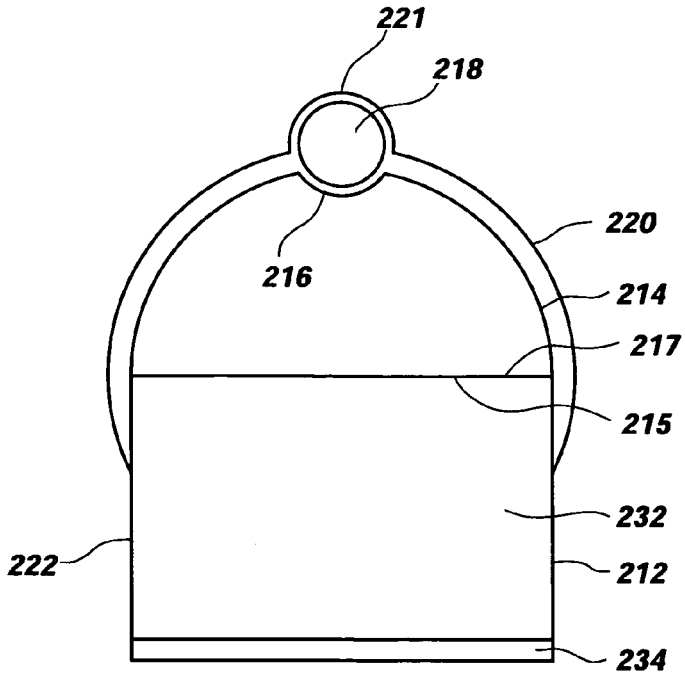
FIG. 4E shows a top view of the generally cylindrical cutting element disposed within the cutting element pocket as shown in FIG. 4D.

FIG. 4E shows a top view of the assembled cutting element retention apparatus 210 of the present invention, as shown in FIG. 4D, wherein generally cylindrical cutting element 212 is disposed so that at least a portion of substantially planar surface 215 matingly engages front surface 217 of support element 214. Front surface 217 may be sized to substantially the same size as the substantially planar surface 215 of generally cylindrical cutting element 212 to provide support thereto. Alternatively, front surface 217 may be sized larger than or smaller than the substantially planar surface 215 of generally cylindrical cutting element 212. Generally cylindrical cutting element 212 may comprise a superabrasive layer 234 forming cutting face 213 affixed to substrate 232, such as in the case of a PDC cutter.

Figure 4F:
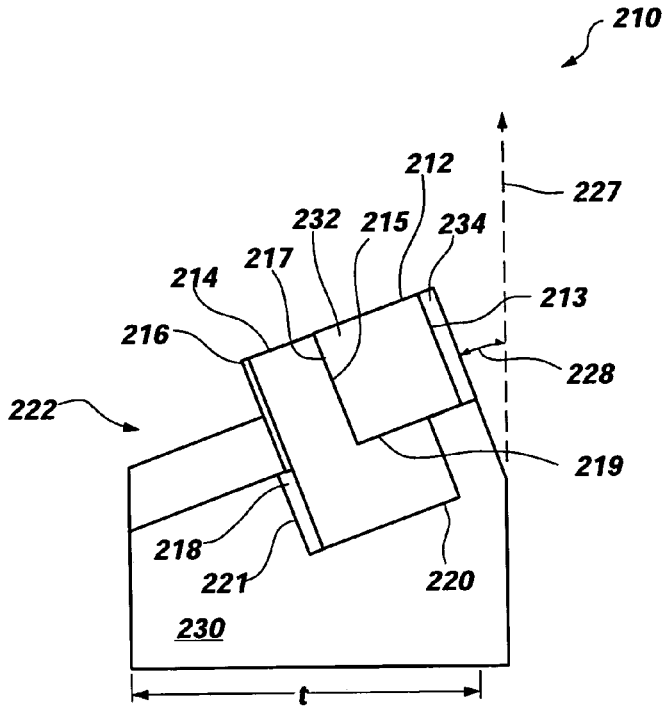
FIG. 4F shows a side cross-sectional view of the cutting element retention apparatus as depicted by FIGS. 4A–4E.

FIG. 4F shows a cross-sectional view of the assembled cutting element retention apparatus 210 as shown in FIG. 4C, depicting generally cylindrical cutting element 212 disposed within recess 222 so that at least a portion of substantially planar surface 215 of the generally cylindrical cutting element 212 matingly engages the front surface 217 of support element 214. Support element 214 may be disposed within retention recess 220 and oriented by way of alignment pin 218 disposed between alignment groove 216 of the support element 214 and alignment groove 221 of the retention recess 220. Cutting face 213 of generally cylindrical cutting element 212 may be disposed at backrake angle 228 with respect to reference axis 227 according to the geometry and orientation of the recess 222, support element 214, and retention recess 220. Generally cylindrical cutting element 212, as shown in FIG. 4F, may comprise a superabrasive layer 234 which forms cutting face 213 affixed to substrate 232, such as in the case of a PDC cutter. Many design alternatives are possible and are contemplated by the present invention, for instance, orienting the front surface 217 of the support element 214 with respect to the direction of rotation of the generally cylindrical cutting element 212 may provide side rake to the cutting face 213 thereof, as known in the art.

Figure 4G:
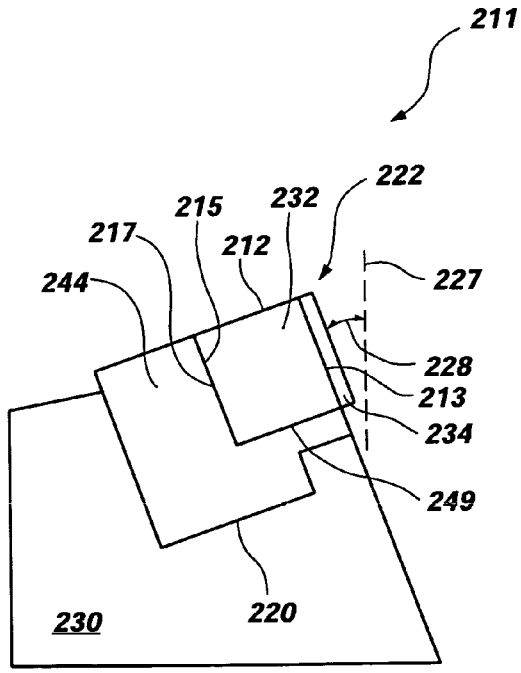
FIG. 4G shows a side cross-sectional view of a further embodiment of an assembled cutting element retention apparatus of the present invention.

Alternatively, as a further embodiment of the present invention, FIG. 4G shows a cross-sectional view of an assembled cutting element retention apparatus 211 illustrating generally cylindrical cutting element 212 disposed within a recess 222 formed substantially entirely by support element 244 and configured so that at least a portion of substantially planar surface 215 of the generally cylindrical cutting element 212 matingly engages the front surface 217 of support element 244. Further, arcuate surface 249 engages at least a portion of the generally cylindrical side surface of generally cylindrical cutting element 212. Support element 244 may be disposed within retention recess 220 and cutting face 213 of generally cylindrical cutting element 212 may be disposed at backrake angle 228 with respect to reference axis 227 according to the geometry and orientation of the retention recess 222, support element 244, and retention recess 220. Generally cylindrical cutting element 212, as shown in FIG. 4G may comprise a superabrasive layer 234 which forms cutting face 213 affixed to substrate 232, such as in the case of a PDC cutter.

In addition, the present invention contemplates that a recess formed within a bit blade may be formed only partially through the thickness thereof. The difficulty in machining only partially through the thickness of the blade with a machining tool having a hemispherical end is that doing so will leave a curved surface at the distal end of the path which may be undesirable for affixing generally cylindrical cutting elements. Further, the spherically curved surfaces may not provide adequate mechanical support even with complementary curved surfaces brazed or affixed thereto. Therefore, it may be advantageous to utilize a machining tool having a spherically curved surface to form a recess within a bit blade, but subsequently eliminate the spherically curved surface to facilitate support for attachment of a cutting element within the recess.

Figure 5A:
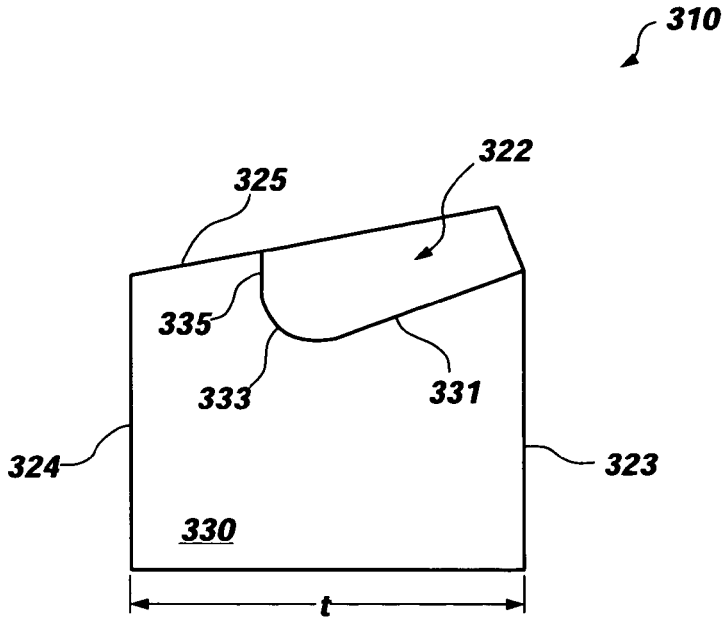
FIG. 5A shows a side cross-sectional view of a recess formed within a bit blade.
Figure 5B:
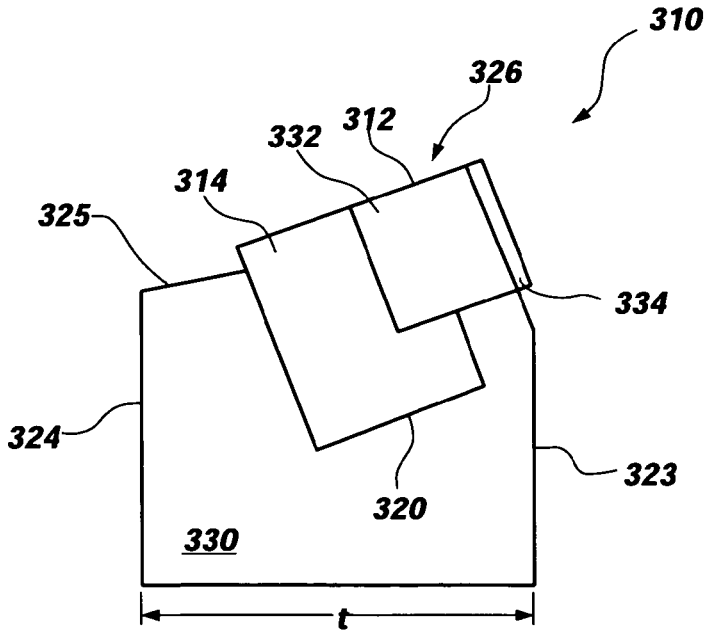
FIG. 5B shows a side cross-sectional view of an embodiment of a cutting element retention apparatus of the present invention.

FIGS. 5A and 5B show cutting element retention apparatus 310 illustrated by a cross-sectional view of bit blade 330 wherein recess 322 may be formed therein by way of movement of a machining tool having a hemispherical end along a straight path between the leading face 323 and the trailing face 324 thereof. As may be seen in FIG. 5A, upper surface 325 of bit blade 330 may not be parallel with the axis of formation of the arcuate surface 331 of recess 322. Therefore, the depth of the recess 322 in relation to upper surface 325 may increase along the thickness t of the bit blade 330 from the leading face 323 to the trailing face 324 thereof.

Recess 322 may be formed within bit blade 330 as described in FIGS. 3A–3B in relation to bit blade 130 and may include arcuate surface 331, hemispherical surface 333, and arcuate surface 335 as formed thereby. Such a process may be advantageous where clearance for machining is limited. However, hemispherical surface 333 may complicate formation of a cutting element pocket for a generally cylindrical cutting element. Therefore, as seen in FIG. 5B, retention recess 320 may be sized and positioned to remove the hemispherical surface 333 as well as arcuate surface 335. Alternatively, where adequate clearance for machining exists, the retention recess 320 may be machined prior to machining recess 322. As shown in FIG. 5B, support element 314 may be disposed within retention recess 320 to form or define a cutting element pocket 326 for affixing generally cylindrical cutting element 312 within. Generally cylindrical cutting element 312 may comprise a superabrasive layer 334 affixed to substrate 332, such as in the case of a PDC cutter.

In addition, many geometrical alternatives are contemplated by the present invention. For instance, if the bit blade 330 has a relatively large thickness t, it may be desirable to form the recess 322 only partially through the thickness, t, thereof. Also, as described hereinabove, one or more surfaces of a cutting element pocket 326 may be formed by the support element 314.

A support element of the present invention of any of the above embodiments may be advantageous for replacement of generally cylindrical cutting elements or modification of the position thereof. For instance, generally cylindrical cutting elements affixed to a drill bit may be replaced with generally cylindrical cutting elements having different geometries using support elements designed therefor. Further, support elements may be utilized to correct minor errors in machining. As another advantage, cutting element pockets formed at least in part by support elements may be preferred over conventional cutting element pockets because if a portion of the cutting element pocket formed by the support element is damaged during drilling operations, the support element may be replaced. In conventional steel body rotary drill bits, damaged cutting element pockets may be more difficult to repair.

In a further aspect of the invention, it may be advantageous to mechanically lock the generally cylindrical cutting element by configuring the side walls of the cutting element pocket to surround more than half of a cross-sectional circumference of the generally cylindrical cutting element in combination with a support element defining at least a portion of the cutting element pocket. Put another way, along at least a portion of the generally or substantially cylindrical surface of a generally cylindrical cutting element, the cutting element pocket surrounds more than half of a cross-sectional circumference thereof. Clarifying further, the cutting element pocket need not surround more than half of the entire generally cylindrical surface of the generally cylindrical cutting element along the entire length thereof. Rather, the cutting element pocket may surround more than half of a circumference of the generally cylindrical cutting element at any position along the length thereof. Thus, any of the above-described embodiments may employ a cutting element pocket surrounding more than half of a cross-sectional circumference of a generally cylindrical cutting element disposed therein. Further, it is contemplated by the present invention that a support element may surround more than half of a cross-sectional circumference of a generally cylindrical cutting element.

Figure 6A:
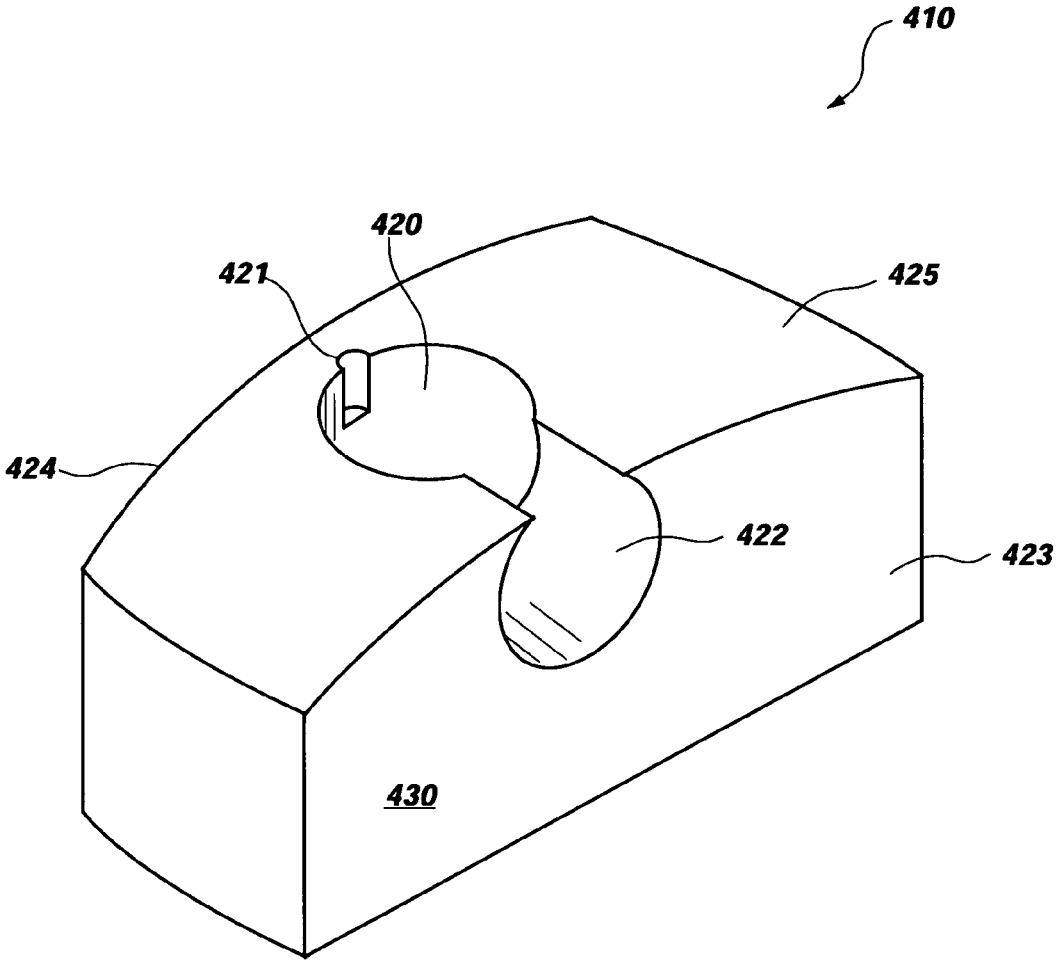
FIG. 6A shows a perspective view of an embodiment of a cutting element retention apparatus of the present invention.

FIGS. 6A–6D illustrate one embodiment of a mechanically locked cutting element retention apparatus 410. As shown in FIG. 6A, recess 422 formed within bit blade 430 may be cylindrical and may be sized and configured to surround more than half of a cross-sectional circumference of a generally cylindrical cutting element disposed therein. As such, a cutting element (not shown) disposed within recess 422 and brazed therein may be retained, notwithstanding fracturing of a portion of the generally cylindrical cutting element (not shown). Retention recess 420, formed within bit blade 430, may also include alignment groove 421 for orienting support element 414 therein by way of an alignment pin (not shown) as described hereinabove with respect to FIGS. 4A–4F.

Figure 6B:
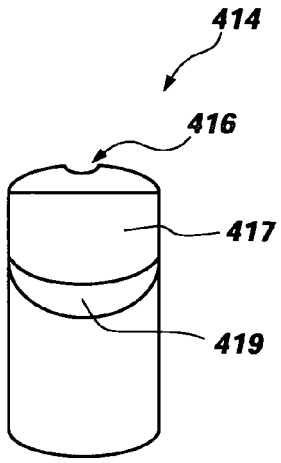
FIGS. 6B–6D show perspective, side, and front views, respectively, of a support element of the present invention.
Figure 6C:
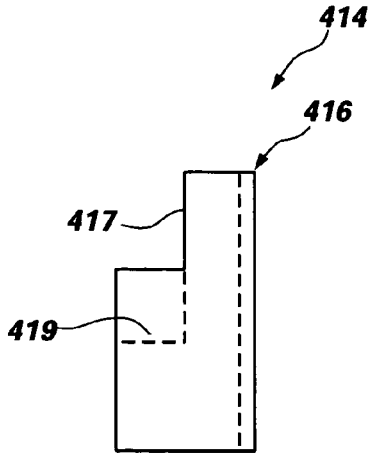
Figure 6D:
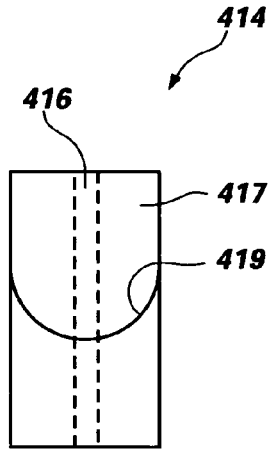

FIGS. 6B–6D illustrate perspective, side, and front views, respectively, of support element 414 configured to support a generally cylindrical cutting element (not shown) disposed within recess 422 upon disposing the support element 414 within retention recess 420. Support element 414 may be press-fit, brazed, shrink-fit, welded, or otherwise affixed to bit blade 430. As shown in FIGS. 6B–6D, support element 414 may be cylindrical and may include front surface 417 for matingly engaging at least a portion of a substantially planar surface of a generally cylindrical cutting element (not shown) as described hereinabove. Support element 414 may also include alignment groove 416 and intermediate surface 419. Intermediate surface 419 may be cylindrical, and may be sized and configured to accept the circumference of a generally cylindrical cutting element (not shown).

Figure 6E:
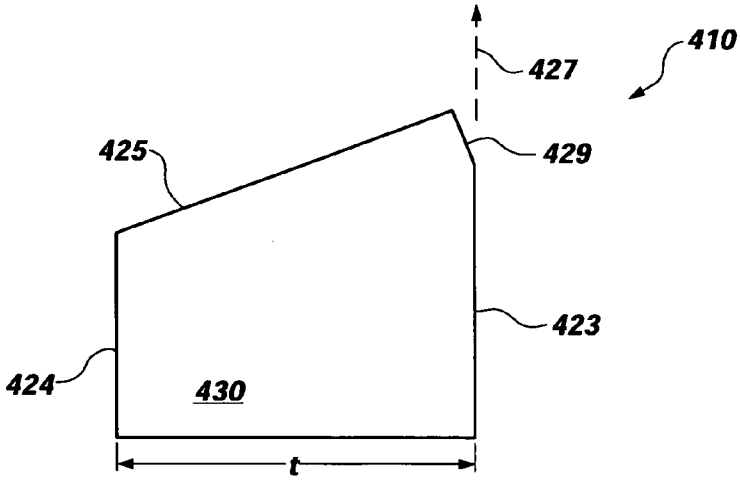
FIGS. 6E–6F show a side cross-sectional view of the formation of a cutting element retention apparatus as shown in FIG. 6A.

FIG. 6E shows a cross-sectional view of bit blade 430 having a leading surface 423 and a trailing surface 424. Reference axis 427 is parallel to the longitudinal axis of the drill bit (not shown). Bit blade 430 also includes upper surface 425 as well as chamfer 429. Chamfer 429 is sized and configured so that the cutting face of a generally cylindrical cutting element (not shown) may not be disposed within the arcuate surface of recess 422. Such a configuration may improve the ability to remove cuttings from the cutting face of a generally cylindrical cutting element, as mentioned above.

Figure 6F:
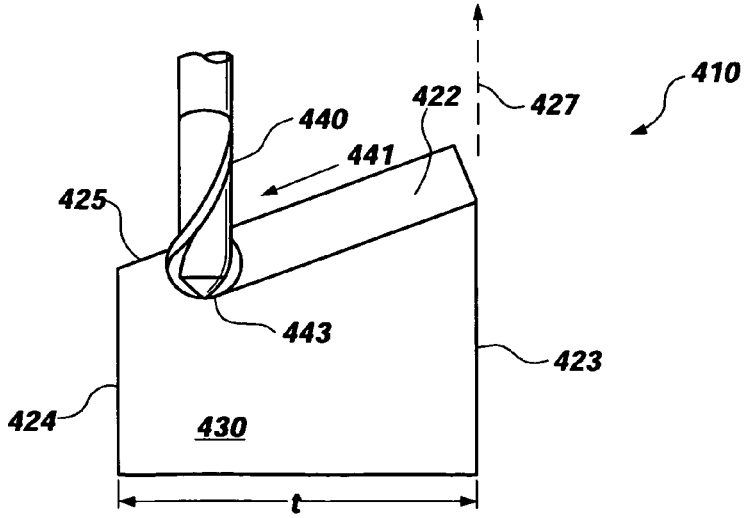

FIG. 6F shows a cross-sectional view of a machining operation in the process of forming recess 422. As shown in FIG. 6F, upper surface 425 of bit blade 430 may taper toward the bit body (not shown) to allow for clearance with respect to the formation during drilling thereof. As also shown in FIG. 6F, machining tool 440 may comprise a so-called "lolli-pop" cutter, or a cutting tool having a partially spherical end 443, wherein the at least partially spherical end 443 is larger than a portion of the machining tool 440 thereabove. Such a configuration may allow for creation of recess 422 that may mechanically lock a generally cylindrical cutting element disposed therein, as shown in FIG. 6A. Machining tool 440 is moved along a straight line along direction 441 between leading surface 423 and trailing surface 424 or thickness (labeled "t") of bit blade 430 to form recess 422. Furthermore, additional machining processes as described hereinabove may be performed to form retention recess 420. It may, however, be preferred to form retention recess 420 prior to forming recess 422, because if the size of retention recess 420 is at least the size of partially spherical end 443 of machining tool 440, the machining tool 440 may be removed from the bit blade 430 therethrough, upon machining into the retention recess 420.

Figure 7A:
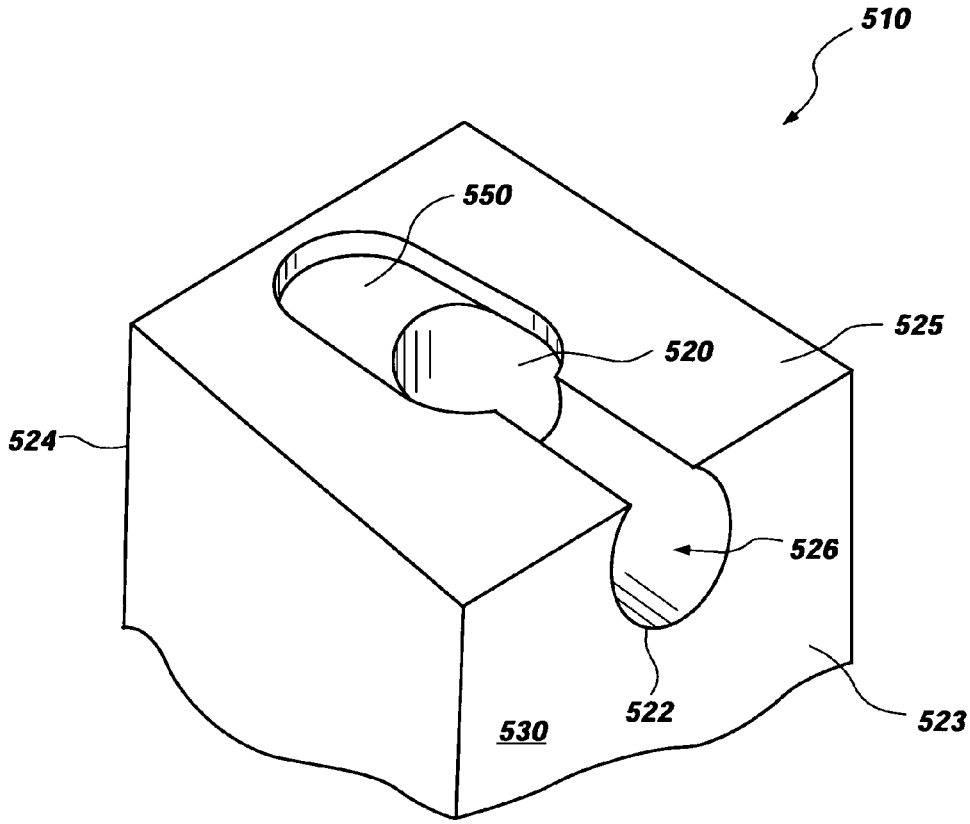
FIG. 7A shows a perspective view of an embodiment of a cutting element retention apparatus of the present invention.
Figure 7B:
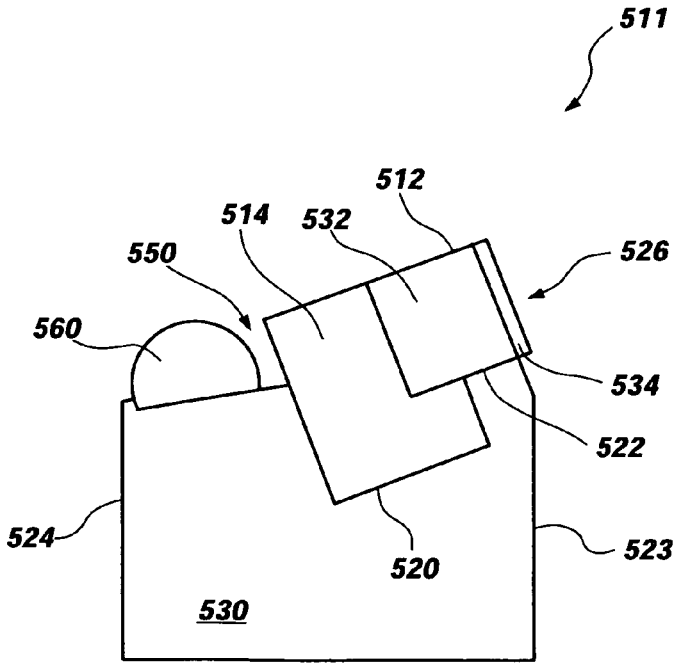
FIG. 7B shows a side cross-sectional view of the cutting element retention apparatus as shown in FIG. 7A.

In another aspect of the present invention, a cavity may be formed for positioning secondary structures. FIGS. 7A and 7B illustrate cutting element retention apparatus 510 and 511 of the present invention. FIG. 7A shows a perspective view of a cutting element retention apparatus 510 of the present invention wherein cavity 550 may be formed generally rotationally trailing cutting element pocket 526 within upper surface 525 of bit blade 530. Also, retention recess 520 may be formed within bit blade 530 as well as recess 522 formed partially through bit blade 530 between leading face 523 and trailing face 524 thereof. Cutting element pocket 526, as shown in FIG. 7A, may be configured to surround more than half of a cross-sectional circumference of a generally cylindrical cutting element (not shown) and, therefore, may mechanically lock a generally cylindrical cutting element disposed therein.

FIG. 7B shows a cross-sectional view of cutting element retention apparatus 511 wherein support element 514 is disposed within retention recess 520, generally cylindrical cutting element 512 is disposed within cutting element pocket 526, and secondary structure 560 is disposed within cavity 550. Secondary structure 560 may be brazed, welded, press-fit, or shrink-fit within cavity 550. Secondary structure 560 may be disposed within cavity 550 and may be configured to limit the rate-of-penetration or depth-of-cut of the generally cylindrical cutting element 512 by contacting the formation during drilling. As known in the art, the secondary structure 560 may be sized and configured to contact the formation under selected drilling conditions. Also, retention recess 520 may be formed within bit blade 530 for retaining support element 514 as described in relation to any of the above-mentioned cutting element retention apparatus embodiments. Generally cylindrical cutting element 512 may comprise a superabrasive layer 534 affixed to substrate 532, such as in the case of a PDC cutter.

Figure 8A:
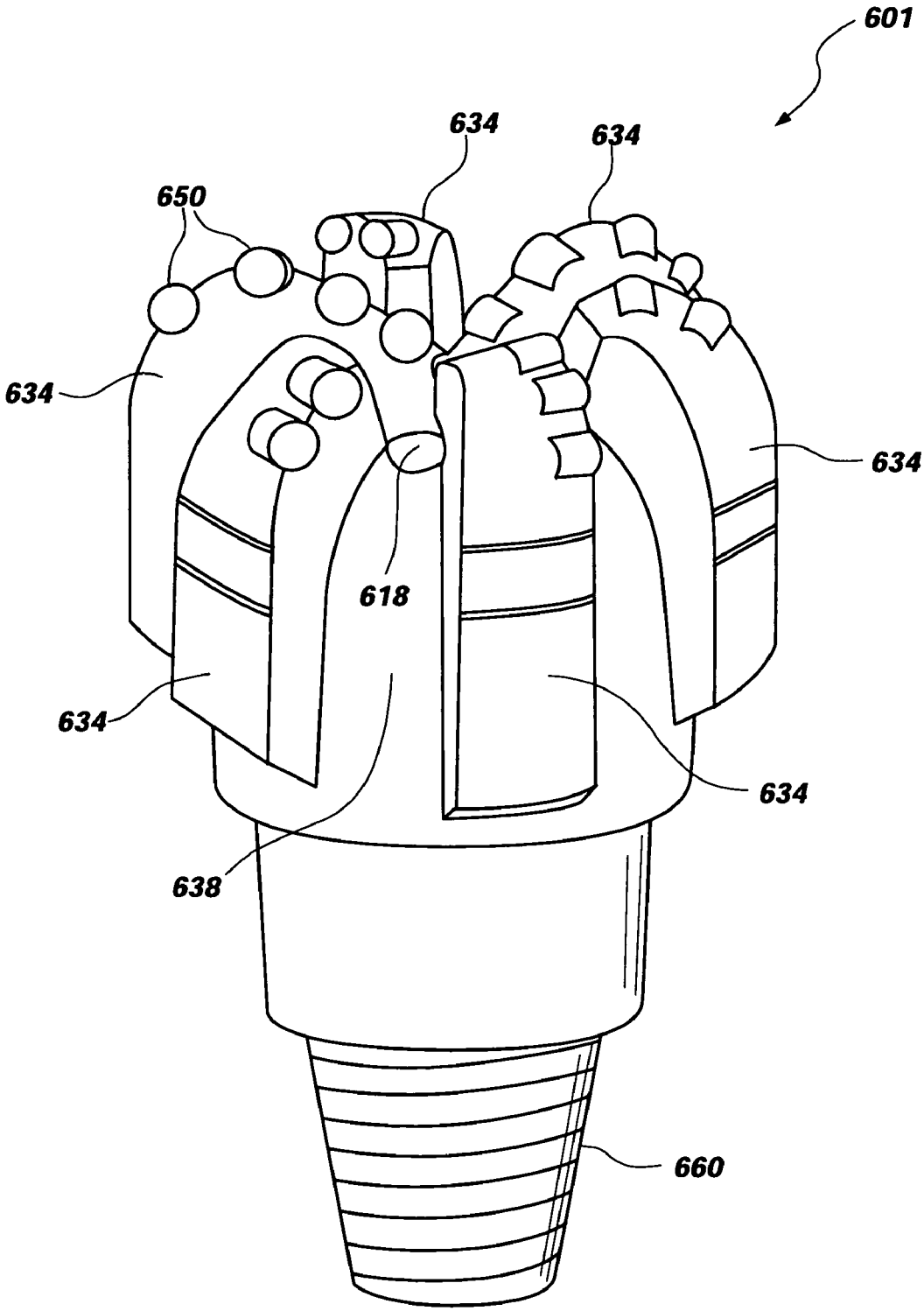
FIGS. 8A and 8B show perspective and top views, respectively, of a steel body rotary drill bit according to the present invention.
Figure 8B:
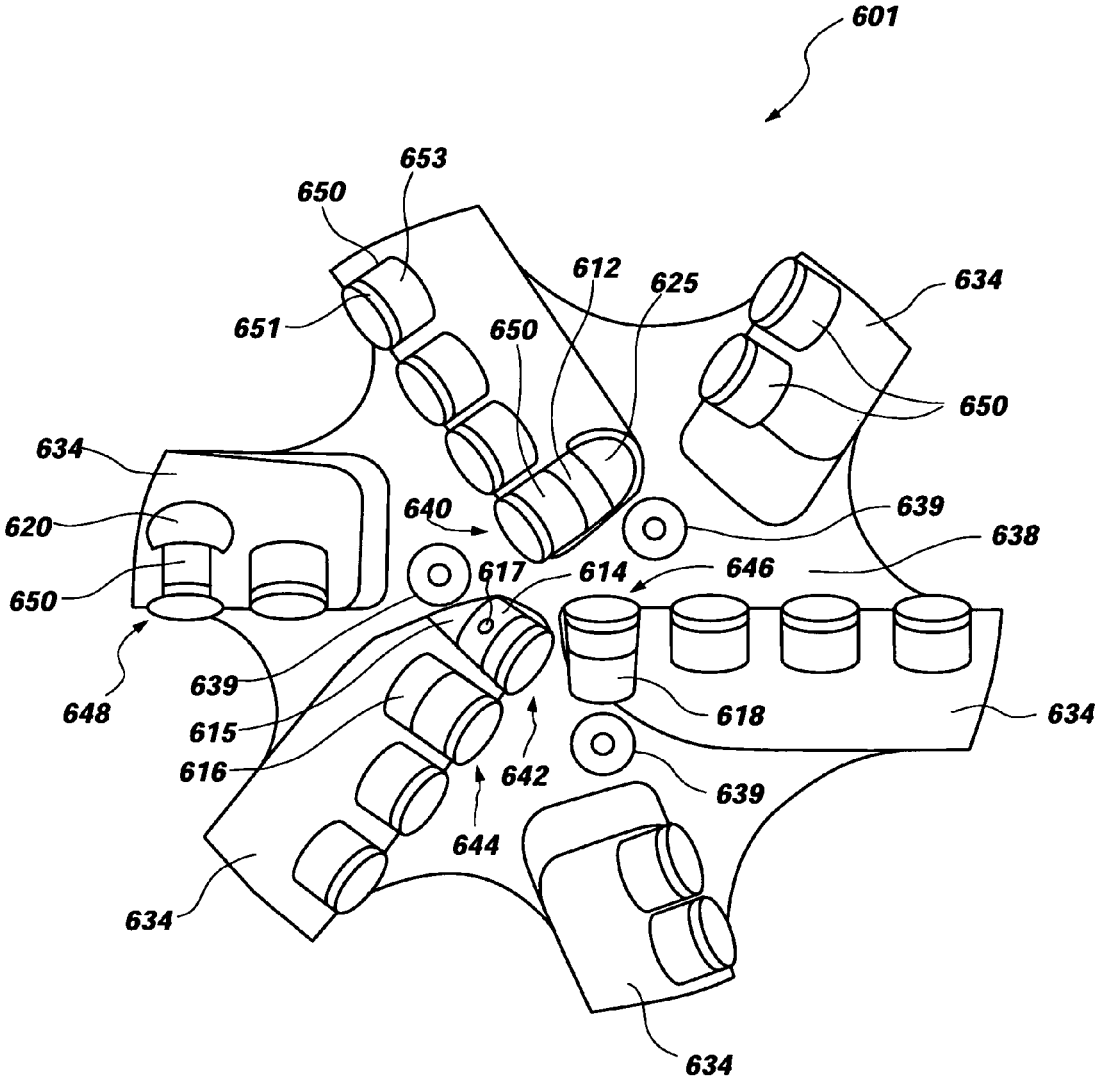

FIGS. 8A and 8B show a perspective view and a top view, respectively, of an example of an exemplary steel body rotary drill bit 601 of the present invention, wherein cutting element pockets 640, 642, 644, 646, and 648 may be at least partially formed by support elements 612, 614, 616, 618, and 620, respectively. Steel body rotary drill bit 601 may also include generally cylindrical cutting elements 650 affixed to radially and longitudinally extending blades 634, nozzle cavities 639 for communicating drilling fluid from the interior of the steel body rotary drill bit 601 to the cutting elements 650, face 638, and threaded pin connection 660 for connecting the steel body rotary drill bits to a drilling string, as known in the art.

Support elements 612, 616, and 620 may comprise any of the above-described embodiments of the present invention. However, more specifically, as shown in FIG. 8B, support element 614 may be disposed within recess 615 that extends through blade 634 and may be affixed thereto by anchor element 617, extending through support element 614. Also as shown in FIG. 8B, secondary structure 625 may rotationally follow or trail in relation to support element 612 and its associated cutting element 650. Additionally, cutting element pocket 648, formed at least in part by support element 620 may surround more than half of a cross-sectional circumference of the generally cylindrical cutting element 650 disposed therein. Support elements 616 and 618 may be press-fit or shrink-fit into a retention recess within their associated blades 634 or face 638 proximate thereto of the steel body rotary drill bit 601. Cutting element 650 may comprise a superabrasive layer 651 affixed to a substrate 653, such as a PDC cutter.

FIGS. 8A and 8B show a perspective view and a top view, respectively, of an example of an exemplary steel body rotary drill bit 601 of the present invention, wherein cutting element pockets 640, 642, 644, 646, and 648 may be at least partially formed by support elements 612, 614, 616, 618, and 620, respectively. Steel body rotary drill bit 601 may also include generally cylindrical cutting elements 650 affixed to radially and longitudinally extending blades 634, nozzle cavities 639 for communicating drilling fluid from the interior of the steel body rotary drill bit 601 to the cutting elements 650, face 638, and threaded pin connection 660 for connecting the steel body rotary drill bits to a drilling string, as known in the art.

Support elements 612, 616, and 620 may comprise any of the above-described embodiments of the present invention. However, more specifically, as shown in FIG. 8B, support element 614 may be disposed within recess 615 that extends through blade 634 and may be affixed thereto by anchor element 617, extending through support element 614. Also as shown in FIG. 8B, secondary structure 625 may rotationally follow or trails in relation to support element 612 and its associated cutting element 650. Additionally, cutting element pocket 648, formed at least in part by support element 620 may surround more than half of a cross-sectional circumference of the generally cylindrical cutting element 650 disposed therein. Support elements 616 and 618 may be press-fit or shrink-fit into a retention recess within their associated blades 634 or face 638 proximate thereto of the steel body rotary drill bit 601. Cutting element 650 may comprise a superabrasive layer 651 affixed to a substrate 653, such as a PDC cutter.

FIGS. 8A and 8B merely depict one example of a drill bit employing various embodiments of a cutting element retention apparatus of the present invention, without limitation. As illustrated and described above, the cutting element retention embodiments of the present invention may be used to form one or more cutting element pockets carried by a steel body rotary drill bit.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility with different and various bit profiles as well as cutter types and configurations.

What is claimed is:

1. A method of manufacturing a steel body rotary drag bit, comprising:

providing a steel bit body having a centerline and including a leading end having a plurality of generally radially extending blades for contacting a formation during drilling;

forming at least one cutting element pocket, wherein forming each of the at least one cutting element pocket comprises:

forming a recess extending at least partially between a leading face and a trailing face of at least one generally radially extending blade;

forming a retention recess that at least partially intersects the recess within the at least one generally radially extending blade;

forming a substantially arcuate surface and a substantially planar surface for matingly engaging at least a portion of a substantially planar surface of a generally cylindrical cutting element distal to the cutting face thereof; and affixing a support element to the steel bit body by way of the retention recess and positioning the support element so as to form at least the substantially planar surface of the at least one cutting element pocket;

disposing a cutting element within each of the at least one cutting element pocket, each cutting element having a substantially cylindrical body, a cutting face, and a substantially planar surface distal to the cutting face; and abutting the substantially planar surface distal to the cutting face of the cutting element against the substantially planar surface of the at least one cutting element pocket within which the cutting element is disposed.

2. The method of claim 1, further comprising affixing the generally cylindrical cutting element to each of the at least one cutting element pocket.

3. The method of claim 1, wherein affixing a support element to the steel bit body comprises deforming an anchor element therethrough.

4. The method of claim 1, wherein affixing a support element to the steel bit body comprises deforming an anchor element thereagainst.

5. The method of claim 1, wherein affixing a support element to the steel bit body comprises deforming an anchor element within the retention recess.

6. The method of claim 1, wherein affixing a support element to the steel bit body comprises at least one of welding, brazing, press-fitting, and shrink-fitting.

7. The method of claim 1, wherein affixing a support element to the steel bit body by way of the retention recess and positioning the support element so as to form at least the substantially planar surface of the cutting element pocket comprises positioning the support element so as to form substantially the entire cutting pocket.

8. A method of repairing a steel body rotary drag bit, comprising:

providing a steel bit body having a centerline and including a leading end having a plurality of generally radially extending blades for contacting a formation during drilling;

forming at least one cutting element pocket, wherein forming each of the at least one cutting element pocket comprises:

forming a recess extending at least partially between leading face and a trailing face of at least one of the plurality of generally radially extending blades;

forming a retention recess that at least partially intersects the recess within the at least one generally radially extending blade;

forming a substantially arcuate surface and a substantially planar surface for matingly engaging at least a portion of a substantially planar surface of a generally cylindrical cutting element distal to the cutting face thereof; and affixing a support element to the steel bit body by way of the retention recess and positioning the support element so as to form at least the substantially planar surface of the at least one cutting element pocket;

disposing a cutting element within each of the at least one cutting element pocket, each cutting element having a substantially cylindrical body, a cutting face, and a substantially planar surface distal to the cutting face;

abutting the substantially planar surface distal to the cutting face of the cutting element with the substantially planar surface of the at least one cutting element pocket within which it is disposed;

affixing the cutting element within the at least one cutting element pocket within which it is disposed;

drilling with the steel body rotary drag bit;

removing the cutting element from the at least one cutting element pocket within which it is disposed; and replacing the cutting element of at least one of the at least one cutting element pocket with another cutting element.

9. The method of claim 8, wherein affixing one or more support element of the at least one cutting element pocket to the steel bit body comprises at least one of welding, brazing, press-fitting, and shrink-fitting.

10. The method of claim 8, wherein affixing the cutting element within the at least one cutting element pocket within which it is disposed comprises affixing a polycrystalline diamond compact within the at least one cutting element pocket within which it is disposed.

11. The method of claim 10, wherein replacing the cutting element of at least one of the at least one cutting element pocket with another cutting element comprises affixing another polycrystalline diamond compact within the at least one of the at least one cutting element pocket.

12. The method of claim 8, wherein replacing the cutting element of at least one of the at least one cutting element pocket with another cutting element comprises removing the support element of the at least one of the at least one cutting element pocket and replacing the support element with another support element.

* * * * *

UNITED STATES PATENT AND TRADEMARK OFFICE

CERTIFICATE OF CORRECTION

PATENT NO. : 7,216,565 B2
APPLICATION NO. : 11/374918
DATED : May 15, 2007
INVENTOR(S) : William H. Sherwood, Jr. et al.

It is certified that error appears in the above-identified patent and that said Letters Patent is hereby corrected as shown below:

| | | |
|---|---|---|
| COLUMN 1, | LINE 11, | change "patent application" to --Patent Application-- |
| COLUMN 2, | LINE 24, | change "collect or chuck" to --collet or chuck-- |
| COLUMN 2, | LINE 28, | change "collect or chuck" to --collet or chuck-- |
| COLUMN 8, | LINE 7, | change "support element. **114**" to --support element **114**-- |
| COLUMN 13, | LINES 9-39, | delete two paragraphs in their entirety beginning with "FIGS. **8**A and **8**B show a perspective . . ." and ending with ". . . **653**, such as a PDC cutter." (They are exact duplicates of the paragraphs starting at col. 12, line 45 and ending at col. 13, line 8.) |

In the claims:
CLAIM 8, COLUMN 14, LINES 60-61, change "between leading face" to --between a leading face--

Signed and Sealed this

Twenty-second Day of December, 2009

David J. Kappos

David J. Kappos
*Director of the United States Patent and Trademark Office*